US008079201B2

(12) United States Patent
Cerè

(10) Patent No.: US 8,079,201 B2
(45) Date of Patent: Dec. 20, 2011

(54) WRAPPING MACHINE AND WRAPPING METHODS

(75) Inventor: Mauro Cerè, Loiano (IT)

(73) Assignee: Aetna Group S.p.A. (IT)

( * ) Notice: Subject to any disclaimer, the term of this patent is extended or adjusted under 35 U.S.C. 154(b) by 164 days.

(21) Appl. No.: 12/307,698

(22) PCT Filed: Jul. 5, 2007

(86) PCT No.: PCT/IB2007/001854
§ 371 (c)(1),
(2), (4) Date: Feb. 18, 2009

(87) PCT Pub. No.: WO2008/007189
PCT Pub. Date: Jan. 17, 2008

(65) Prior Publication Data

US 2009/0288372 A1 Nov. 26, 2009

(30) Foreign Application Priority Data

Jul. 7, 2006 (IT) ..... MO2006A0221

(51) Int. Cl.
*B65B 11/02* (2006.01)

(52) U.S. Cl. ..... 53/399; 53/441; 53/556; 53/588

(58) Field of Classification Search ..... 53/399, 53/441, 556, 588; *B65B 11/02*
See application file for complete search history.

(56) References Cited

U.S. PATENT DOCUMENTS

| | | | | |
|---|---|---|---|---|
| 4,862,678 | A | 9/1989 | Humphrey | |
| 4,953,336 | A * | 9/1990 | Lancaster et al. | 53/556 |
| 5,311,725 | A * | 5/1994 | Martin et al. | 53/556 |
| 5,875,616 | A * | 3/1999 | Paavola et al. | 53/556 |
| 5,878,555 | A * | 3/1999 | Turfan et al. | 53/588 |
| 6,826,893 | B2 * | 12/2004 | Cere | 53/556 |
| 2006/0213155 | A1 * | 9/2006 | Forni et al. | 53/588 |

FOREIGN PATENT DOCUMENTS

| | | | |
|---|---|---|---|
| DE | 4234604 | A1 * | 4/1994 |
| EP | 96635 | A2 * | 12/1983 |
| EP | 0 246 659 | A1 | 11/1987 |
| EP | 0 306 573 | A1 | 3/1989 |
| EP | 0 811 554 | A1 | 12/1997 |
| EP | 0 936 141 | A1 | 8/1999 |
| EP | 1 213 223 | A1 | 6/2002 |
| EP | 1319596 | A2 * | 6/2003 |
| GB | 2154536 | A | 9/1985 |
| JP | 11165705 | A * | 6/1999 |
| WO | WO 98/22346 | A1 | 5/1998 |
| WO | 2007071593 | A1 | 6/2007 |

* cited by examiner

*Primary Examiner* — Stephen F Gerrity
(74) *Attorney, Agent, or Firm* — Laubscher & Laubscher, P.C.

(57) ABSTRACT

A wrapping machine for wrapping a product with a plastic film including a supporting frame with which a ring arrangement is associated that rotates around a wrapping axis of the film and around the product. The supporting frame further supports a carriage arranged for supporting a reel of the film and for supporting a first roller and a second roller for unwinding and stretching the film. A first motor and a second motor are mounted on the supporting frame and coupled, respectively, with the first roller and the second roller.

25 Claims, 8 Drawing Sheets

WRAPPING MACHINE AND WRAPPING METHODS

This application is the national stage filed under 35 USC §371 of PCT International Application No. PCT/IB2007/001854 filed Jul. 5, 2007. PCT/IB2007/001854 claims priority to IT Application No. MO2006A000221 filed Jul. 7, 2006. The entire contents of these applications are incorporated herein by reference.

The invention relates to a wrapping machine for wrapping a product with a stretch plastic film and wrapping methods for wrapping said film on said product.

Wrapping machines are known comprising a supporting frame, a supporting structure and a reel-holding carriage.

The supporting frame, which is bridge-shaped, is arranged for supporting the supporting structure and is positioned at a zone in which it is desired to wrap the products, conveyed thereto, for example, by a conveyor belt, that is slidable under the supporting frame.

The supporting frame further comprises a carriage arranged for moving the supporting structure along a vertical axis.

The supporting structure comprises a rotating ring rotated around a vertical wrapping axis by a belt driven by a gear box.

The rotating ring supports the reel-holding carriage and a counterweight of a weight that is suitable for balancing the weight of the reel-holding carriage.

The reel-holding carriage supports a reel of plastic stretch film and an unwinding and pre-stretch unit arranged for unwinding and stretching or elongating the film made of plastics.

The unwinding and pre-stretch unit is provided with a pair of prestretching rollers comprising a slow and a fast roller, respectively upstream and downstream of the movement of the film, to stretch and unwind the extendible film and one or more deviating rollers for deviating the film during unwinding.

The unwinding and pre-stretch unit is provided with an electric motor, for example an alternating-current, direct-current or brushless electric motor, which motor is also supported by the reel-holding carriage and is able to rotate one of the two prestretching rollers that act as driving (master) roller, which roller is typically the fast roller that via a belt transmission unit or cog transmission unit drives the other prestretching roller that acts as a driven (slave) roller, which roller is typically the slow roller.

In this way, between the fast roller and the slow roller a fixed transmission ratio is established, in function of the prestretching or elongation that it is desired to obtain on the film. In use, the film in fact passes from the slow roller to the fast roller and owing to the difference in rotation speed between the latter, set by the aforesaid transmission ratio, the aforesaid film is subjected to a prestretching or elongation force. This enables the portion of film comprised between the two prestretching rollers to be stretched and elongated before the later is wound on the products, both for using as well as possible the available film and for changing the mechanical features of the material of the film, in function of the product to be wound.

As known, the prestretching force enables the thickness of the film to be reduced significantly (typically from approximately 25/23 μm to approximately 6/7 μm) so as to increase the length thereof proportionally, to wrap a greater number of products.

The prestretching force to which to subject the film to obtain a given elongation percentage depends both on the initial thickness of the film and on the physical/mechanical features of the material, such as composition, quantity and distribution of possible impurities and internal irregularities. For this reason, films of the same material and the same thickness belonging to different reels often have to be subjected to different prestretching forces to obtain similar elongation percentages.

The prestretching force further enables the mechanical features of the film to be changed. The suitably stretched material of the latter can in fact change from elastic behaviour, in which the film tends to recover the original dimension at the end of the stress, to plastic behaviour, in which the film undergoes a permanent deformation and does not regain the initial dimension at the end of stress. In this latter case the film of plastics acts as a flexible and unextendable element, the same as a rope or a belt, and can be used, for example, to wrap groups of unstable products that have to be maintained firmly bound together.

The electric motor that drives the prestretching driving roller can be supplied by an alternator, positioned on the reel-holding carriage, provided with a sprocket that engages a rack positioned on a coaxial fixed ring and arranged outside the rotating ring.

In this way, when the rotating ring rotates, the sprocket is rotated by the fixed rack and generates the current that supplies the motor.

In other machines, the alternator can be provided with a pulley rotated by a fixed belt.

The belt is arranged for rotating the pulley when the rotating ring is rotated that supports the alternator, so as to generate the current that drives the motor.

Alternatively, the electric motor can be driven by batteries positioned on the rotating ring on the side opposite the reel-holding carriage.

The unwinding and pre-stretch unit further comprises a control device, associated with the reel-holding carriage, arranged for varying the rotation speed of the driving roller, and thus the film unwinding speed in accordance with the shape or cross section of the product to be wound and with the corresponding angular position between the latter and the reel-holding carriage. This enables the wrapping traction or tension force of the film around the product, the so-called "pull" to be maintained more or less constant, to prevent breakage thereof or to prevent a value that is not suitable and appropriate to the type of product to be wound. For example, a relatively fragile single product has to be wound with sufficient tension to maintain the film adhering to the product but not with such as to deform or break the latter. On the other hand, a group of undeformable products placed on a pallet will have to be wound at greater tension to confer stability and compactness on the packed group.

The control device generally comprises a so-called "dandy" or "guide" roll, mounted on an elastic support that is movable away from and towards the product to be wound, as a function of the force exerted thereupon by the film wound around the product during a wrapping phase.

In this way, when the dandy roll moves towards or away from the product to be wrapped, an electric signal is sent to a management and control unit, which, through the electric motor increases or decreases the rotation speed of the drive motor, and thus via the transmission unit the rotation speed of the driven roller, so as to increase or decrease the unwinding speed of the film, at the same rotation speed as the rotating ring and maintain more or less constant the prestretching force and the tension of the film.

When it is desired to wrap a product with an extendible film made of plastics, the product is first positioned substantially at the vertical wrapping axis, and the wrapping machine is driven that moves the supporting structure.

The latter moves the reel-holding carriage along a circular or helical trajectory so as to wrap the products with several coils of film along the vertical wrapping axis, the latter substantially coinciding with the vertical axis of the products to be wound.

The aforesaid description, albeit with certain different technical details, can also extend to wrapping machines in which the supporting structure develops along a vertical plane and the products advance along a horizontal plane passing through the rotating ring to be wound by the film in successive coils along a horizontal wrapping axis.

A drawback of the aforesaid machines is the considerable weight of the rotating ring that during operation generates considerable forces of inertia that are mainly due to the weight of the electric motor, of the counterweights, of the dandy roll and, where present, of the alternator and of the batteries.

This greatly reduces the rotation speed of the rotating ring and consequently limits the productivity of the wrapping machine.

Further, to counteract these inertia forces it is necessary to stiffen significantly the supporting structure and the frame, with a consequent further increase in weight and costs.

A further drawback relates to the creeping contacts used to supply the electric motor, which on the one hand are subject to serious wear and thus have to be replaced frequently and on the other hand further limit the rotation speed of the rotating ring and therefore the productivity of the wrapping machine.

These contacts may further cause sparks and prevent the wrapping machine being installed in environments having a high level of humidity.

Further, where batteries are used, the latter, in addition to being costly, have to be recharged during machine downtime.

If an alternator is used, this causes an increase in the weight to be rotated and further generates current only after the rotating ring starts to rotate, which does not enable the film to be prestretched in an initial wrapping phase.

A further drawback of these machines consists of the operations that are necessary for varying the transmission ratio between the prestretching rollers to vary the prestretching or elongation of the film when it is desired to use different film made of plastics, or when it is desired to wrap products of different types, for example groups of stacked products.

These operations, which comprise stopping the wrapping machine, dismantling the transmission unit and refitting a new transmission unit, are extremely slow and laborious and require specialised labour for the performance thereof.

For this reason, the known wrapping machines do not enable the film of plastics of each reel to be used in an optimal manner, adjusting suitably the prestretching force in function of the physical and mechanical features of the film of the reel in use.

Still another drawback of the aforesaid wrapping machines consists of the difficulty of maintaining constant the tension of the film wound around the product, especially if the latter has a complex profile or shape, for example an elongated shape, and/or the machine has a rotating ring with high rotation speeds.

This is due to the fact that the reel-holding carriage travels a certain angular sector between the moment in which the dandy roll is affected by the variation in tension exerted by the film and the moment in which the management and control unit commands the electric motor that varies the rotation speed of the prestretching rollers.

This causes a delay in the dispatch of the electric control signal to the motor, a delay that is greater the greater the rotation speed of the rotating ring and/or the dimensions and the shape of the product to be wound. This delay in the feedback of the prestretching rollers may cause excessive tensioning of the film in non-desired portions of the product to be wound and may lead to the breaking of the film.

An object of the invention is to improve the wrapping machines arranged for wrapping a product with a film of plastics and the methods for wrapping the film on the product.

A further object of the invention is to make a wrapping machine that is able to operate at high rotation speeds of the rotating ring so as to increase productivity compared with known machines.

Another further object is to provide a wrapping machine and a wrapping method that enable the transmission ratio between the prestretching rollers to be varied in a simple, fast and precise manner.

Another object is to provide a wrapping machine and a wrapping method that enable the film of plastics with which to wrap a product to be exploited in an optimal manner.

A still further object is to provide a wrapping machine and method that enables the tension or "pull" of the film wound around the product to be maintained virtually constant even at high rotation speeds of the rotating ring.

In a first aspect of the invention a wrapping machine is provided for wrapping a product with a plastic film comprising, a supporting frame, with which a ring arrangement is associated that rotates around a wrapping axis of the film around the product and supports a carriage arranged for supporting a reel of the film and for supporting a first roller and a second roller for unwinding and stretching the film. A first motor is fixed to the supporting frame and coupled with the first roller. The wrapping machine further comprises a second motor fixed to the supporting frame and coupled with the second roller.

Owing to this aspect of the invention it is possible to increase the productivity of the wrapping machines.

In fact, as the first and the second motors are fixed to the supporting frame, it is possible to lighten significantly the weight of the rotating ring. This, in addition to providing a simpler and less costly structure, enables the rotation speed of the ring arrangement to be increased significantly because of the inert masses.

Further, the first motor and the second motor are arranged for rotating, through a respective driving device, for example a flexible driving device, for the respective rollers.

This enables the rollers to be driven in an independent manner to vary in a rapid and precise manner the rotation speed of the latter. In this way it is possible to regulate and control during operation both wrapping tension and a prestretching force or elongation to which to subject the film of plastics during wrapping on the product in function of the features of the film used or of the type of product to be wound.

In a second aspect of the invention a method is provided comprising the steps of unwinding a film initially wound on a reel by a roller and wrapping a product with the film while maintaining a desired tension on the film. The unwinding step includes rotating the roller by a motor around a longitudinal axis at a rotation speed such as to give to the film the desired tension. The method further comprises detecting an operating parameter of the motor, comparing the operating parameter with a reference parameter, and intervening on the motor in such a way as to decrease a deviation detected between the operating parameter and the reference parameter.

Owing to this aspect of the invention, it is possible to adjust with a feedback control the operation of the motor in such a way as to maintain the tension almost constant to which the film is subjected during wrapping, to obtain a package having desired features. The tension of the film tends to vary, in fact, during wrapping on the product owing to the profile and/or the dimensions of the latter.

The method further provides detecting as an operating parameter the value of a resisting torque acting on the first motor and produced by the tension that the film exerts on the first roller. During operation, variations in the tension of the film cause corresponding variations in the tension of the operating parameter of the motor. On the basis of these variations the first motor is driven in such a way as to increase or diminish the rotation speed of the first roller to vary the unwinding speed of the film and return the wrapping tension to the preset value.

This method, in addition to being particularly simple and easy to make, does not require the use of a dandy roll for measuring the tension of the film. This enables the carriage to operate at high rotation speeds and at the same time enables wrapping tensions of an undesired/variable value to be reduced.

In a third aspect of the invention, a method is provided comprising unwinding a plastic film initially wound on a reel by a first roller arranged further downstream and driven by a first motor, and by a second roller arranged further upstream, stretching the film by rotating the first roller at a first speed that is greater than a second speed at which the second roller rotates, wherein the stretching step comprises individually controlling the first motor and a second motor driving the second roller.

Owing to this aspect of the invention, it is possible to drive individually a first roller and a second roller by respective motors to vary the rotation speed thereof rapidly and precisely, a difference thereof determining a corresponding value of the prestretching force or elongation to which to subject the film. This thus enables the speeds of the rollers to be adjusted in such a way as to maintain the speed difference thereof almost constant during the entire film wrapping process.

The method further provides a calibrating phase with which to determine, for each new reel of film, an operating difference between the speeds of the rollers to be adopted during operation of the machine, i.e. the prestretching force to which to subject the film for better use thereof and to prevent tears and breakages thereof at the same time.

The invention can be better understood and implemented with reference to the attached drawings that illustrate some embodiments thereof by way of non-limiting example, in which.

Figure 4:
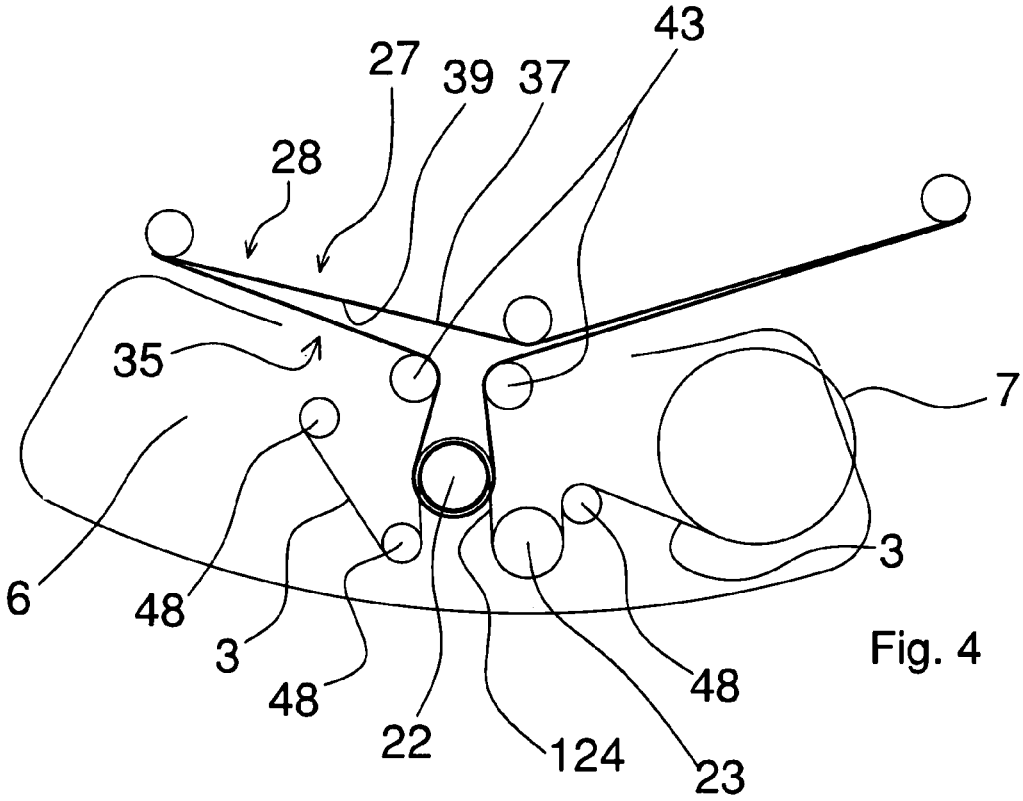
FIG. 4 is a schematic view from above of a first motion transmitting device included in the wrapping machine of FIG. 1.
Figure 5:
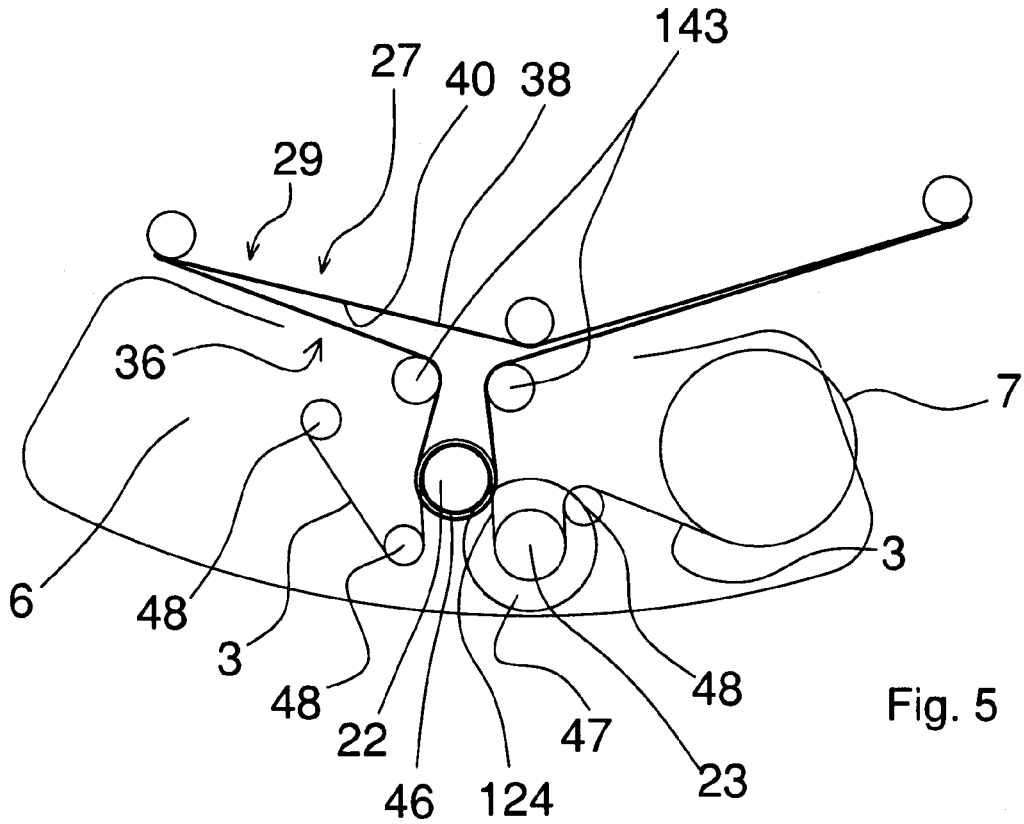
FIG. 5 is a schematic view from above of a second motion transmitting device included in the wrapping machine of FIG. 1.
Figure 6:
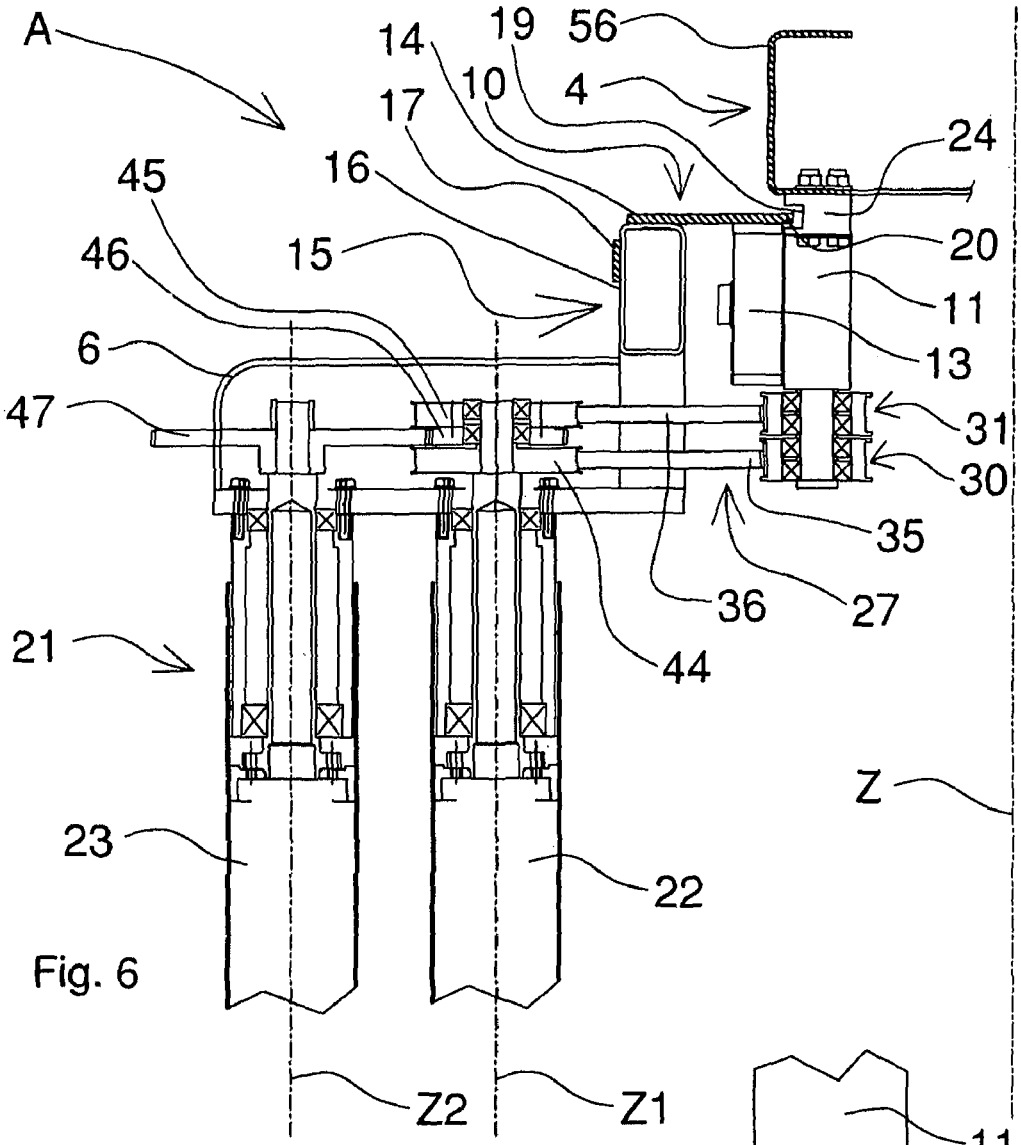
FIG. 6 is a fragmentary schematic front view and with some sectioned parts of a driving mechanism of a pre-stretch unit included in the wrapping machine, in a first embodiment.
Figure 6B:
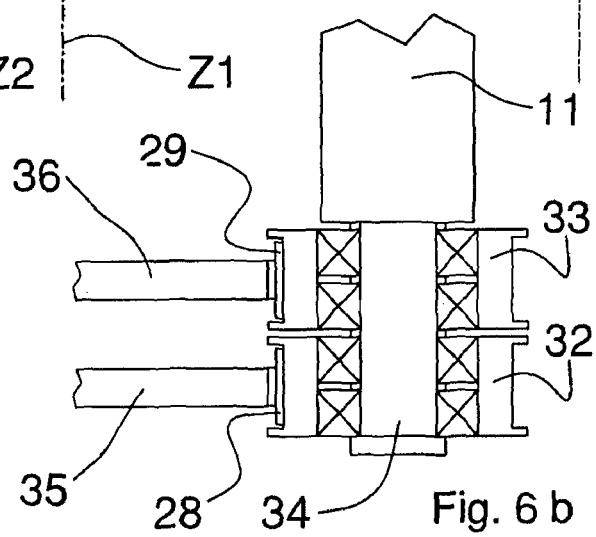
Figure 7:
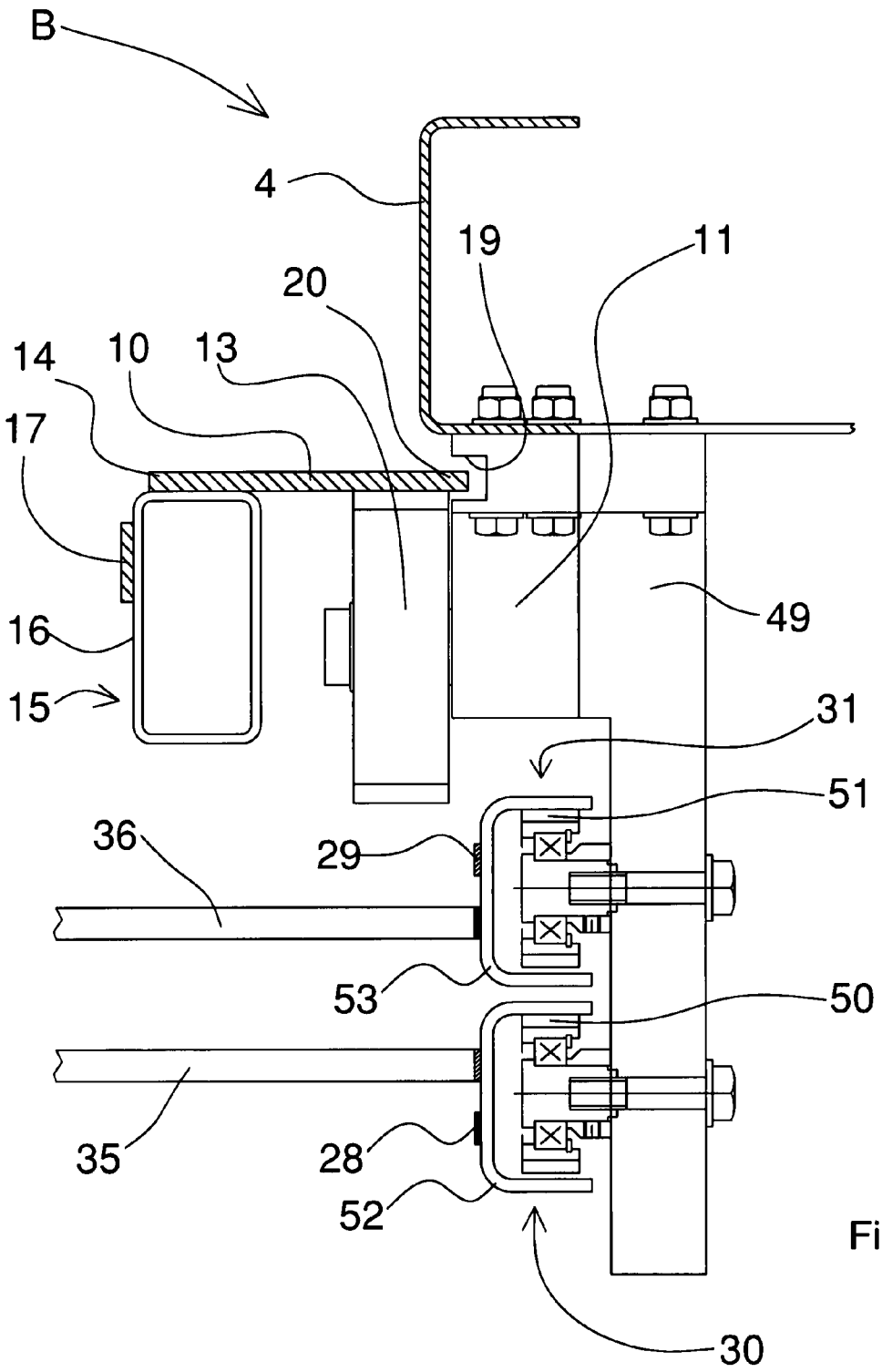
Figure 8:
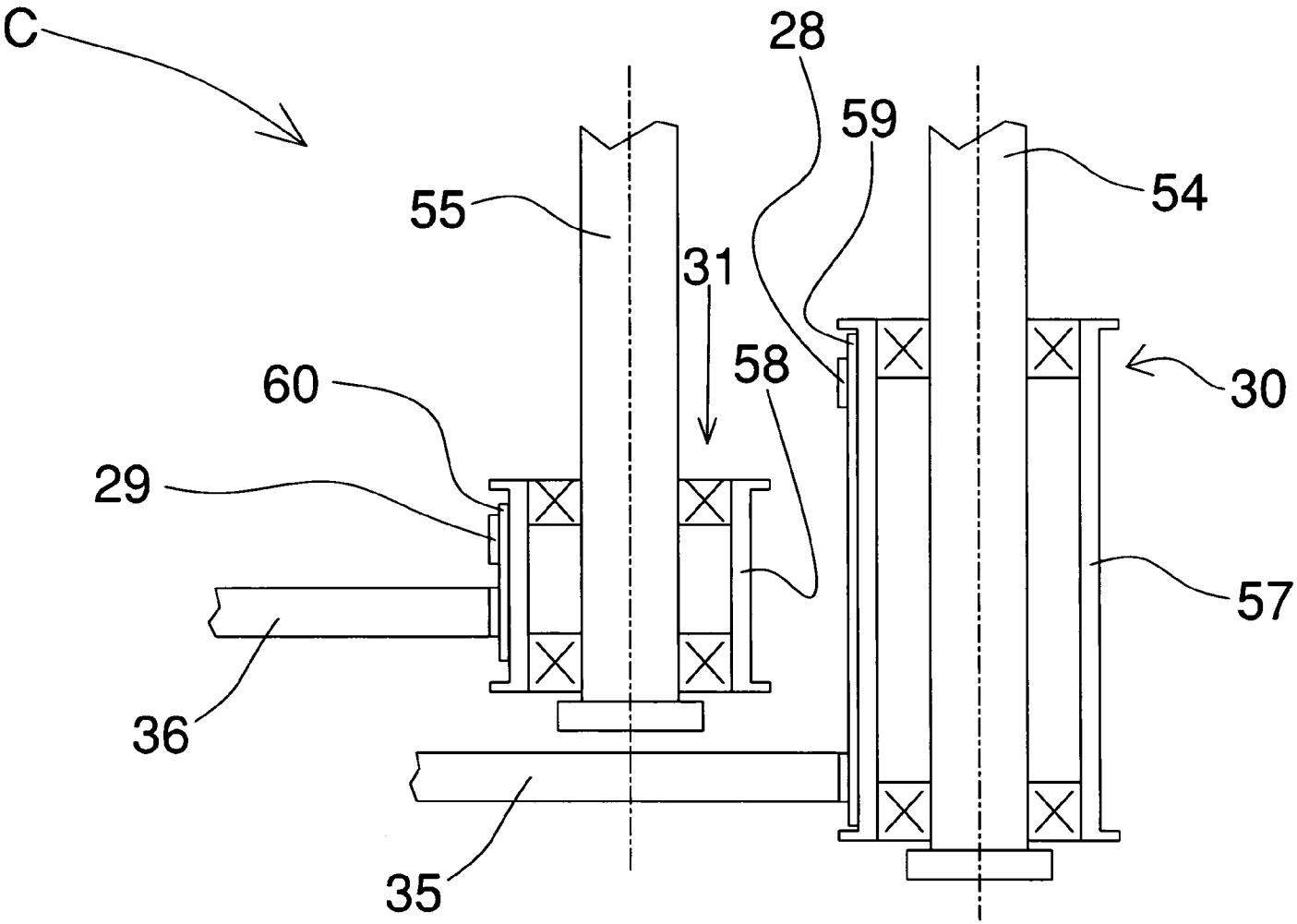
Figure 9:
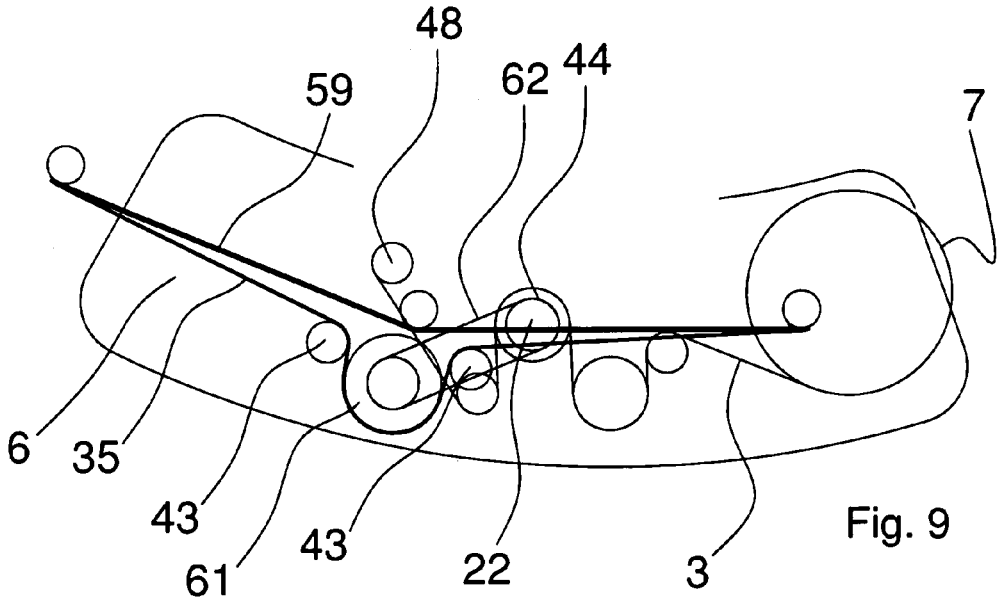
Figure 10:
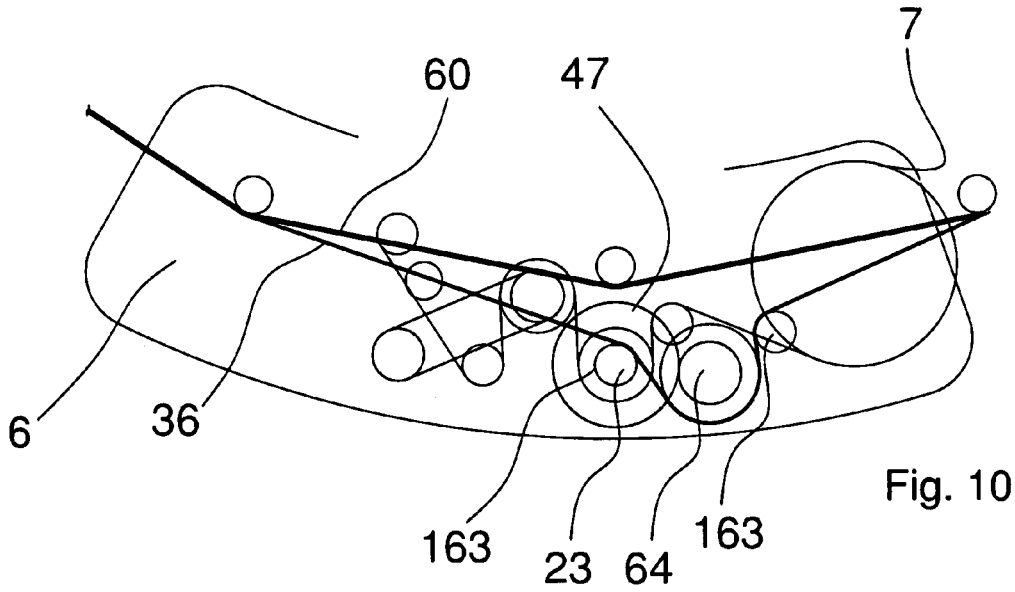
Figure 11:
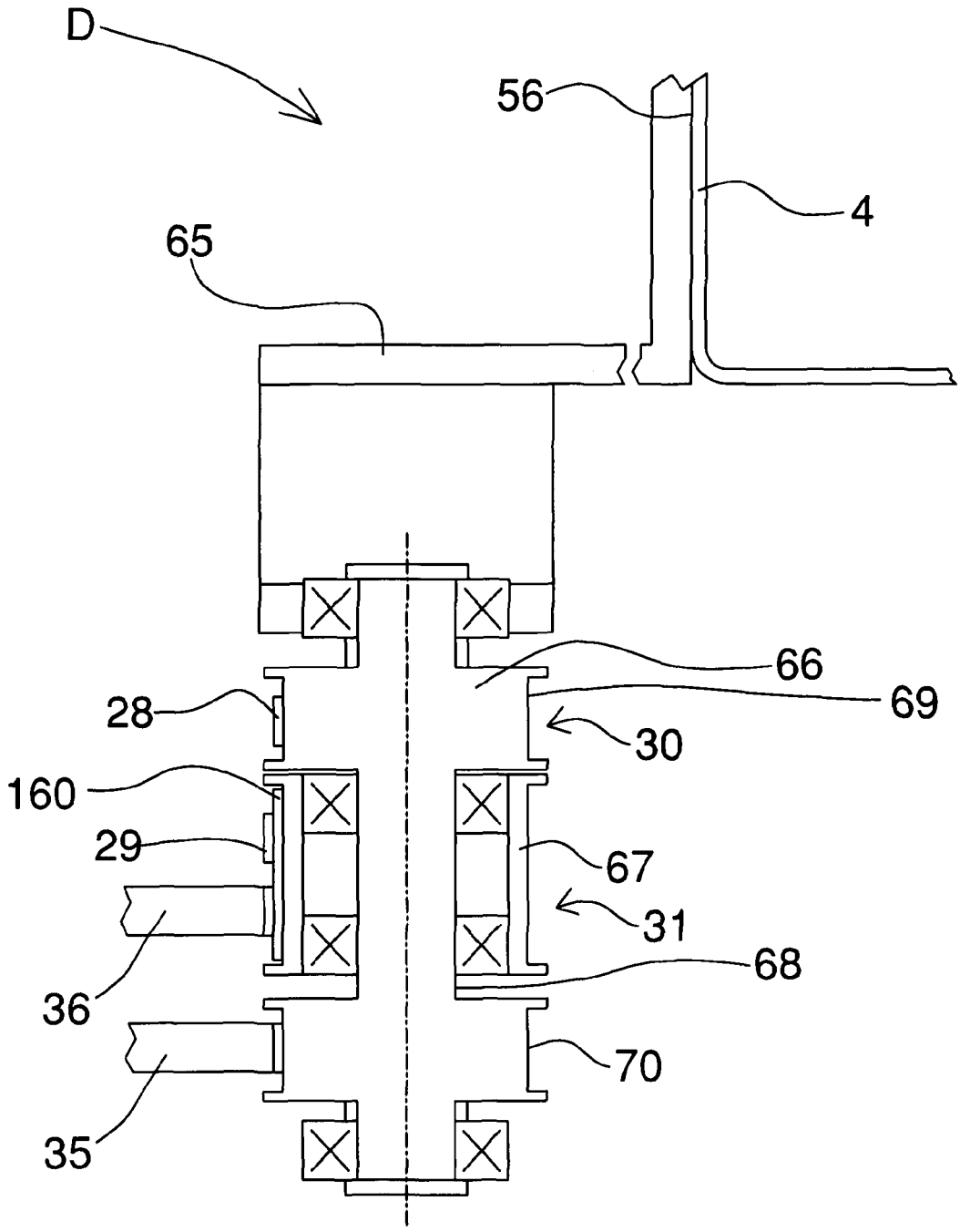

FIG. 6*b* is an enlarged detail of FIG. 6;

FIG. 7 is a fragmentary schematic front view and with some sectioned parts of the driving mechanism of FIG. 5 in a second embodiment;

FIG. 8 is a fragmentary schematic front view and with some sectioned parts of the driving mechanism of FIG. 6 in a third embodiment;

FIG. 9 is a schematic top view of a version of the first transmitting device of FIG. 4;

FIG. 10 is a schematic top view of a version of the second transmitting device of FIG. 5;

FIG. 11 is a fragmentary schematic front view and with some sectioned parts of the driving mechanism of FIG. 6 in a fourth embodiment.

With reference to FIGS. 1 to 6*b*, a wrapping machine 1 is shown that is arranged for wrapping a product 2 with a plastic film 3, for example a film of extendible plastics wound on a reel 7.

The wrapping machine 1 comprises a frame 4 supporting a supporting structure 5 of a carriage 6.

The frame 4, for example bridge-shaped, is associated with a plurality of uprights 8, for example four of them, substantially vertical.

The uprights 8 are fixable to a floor at a zone in which it is desired to wrap products 2 that are transported there by a conveying device that is not shown, for example comprising a conveyor belt that is slidable below the frame 4.

Each upright 8 acts as a supporting guide for a carriage, which is not shown, that is associated with the frame 4 and is slidable along an axis that is substantially vertical and substantially parallel to the wrapping axis Z.

In this way, in use, the carriages move the frame 4 along the wrapping axis Z.

With the frame 4 in a peripheral portion thereof, a plurality of supporting elements 11 are associated that are suitably angularly spaced from one another by fixing elements 24, provided with a groove 19.

With each supporting element 11 there is associated a wheel 13, projecting radially outwards in relation to the aforesaid peripheral portion and free to rotate around a substantially horizontal axis thereof.

In an embodiment of the invention that is not shown each wheel 13 projects radially inside with respect to the aforesaid peripheral portion.

The supporting structure 5 comprises a rotatable ring 10, supported by the frame 4 by means of the wheels 13.

In this way, in use, the rotatable ring 10, supported by the frame 4, is rotatable with respect to the latter around the wrapping axis Z.

The rotatable ring 10 comprises a first end portion 20 projecting at least partially inside the grooves 19, and a second end portion 14 opposite the first end portion 20 and supporting a profiled supporting section 15, having a substantially rectangular section and arranged for supporting the carriage 6.

The profiled section 15 is provided with an active portion 16 on which a main driving belt 17 engages that is arranged for rotating the rotatable ring 10.

The main driving belt 17 is rotated by a main motor 18, for example electric, supported by the frame 4.

In an embodiment of the invention that is not shown, the rotatable ring 10 can be rotated, for example by a sprocket engaging with toothing arranged on the active side of the profiled section.

With the rotatable ring 10 there is associated the carriage 6 supporting the reel 7 and a prestretching unit 21 of the film 3.

The prestretching unit 21 comprises tensioning rollers 48 arranged for tensioning the film 3 and each free to rotate around a respective rotation axis that is substantially parallel to the wrapping axis Z.

The prestretching unit 21 comprises a first roller 22 placed downstream of a second roller 23, said first roller 22 and said second roller 23 rotating respectively around a first rotation axis Z1 and a second rotation axis Z2 that are substantially parallel to the wrapping axis Z, at different rotation speeds.

In particular, the first roller 22 rotates said fast wheel at a first speed that is greater than a second speed at which it rotates said second slow roller 23. In this way, in use, a portion of film 124 interposed between the second roller 23 and the first roller 22 is subjected to a prestretching force, i.e. an elongating action that is greater the greater is the difference between the two rotation speeds of the rollers.

The first roller 22 and the second roller 23 are driven respectively by a first motor 25 and by a second motor 26, for example electric, supported by the frame 4. The speed of the first roller 22 defines an unwinding speed of the film from the prestretching unit 21.

The winding machine 1 comprises an electronic management and control unit, of known type and not illustrated in the Figures, that is suitable for controlling and adjusting the operation of the main motor 18, of the first motor 25 and of the second motor 26.

The wrapping machine 1 further comprises a flexible driving mechanism 27 arranged for transmitting motion from the first motor 25 and from the second motor 26 respectively to the first roller 22 and to the second roller 23.

In an embodiment of the invention, which is not shown, the wrapping machine 1 is provided with a driving mechanism comprising a plurality of fifth -wheels, that are free to rotate around respective rotation axes substantially parallel to the vertical wrapping axis Z, arranged for transmitting motion from the first motor 25 and from the second motor 26, respectively, to the first roller 22 and to the second roller 23.

The flexible driving mechanism 27 comprises in a first configuration A, shown in FIGS. 6 and 6*b*, a first driving belt 28 and a second driving belt 29.

The first driving belt 28 and the second driving belt 29, are wound respectively around a first pulley arrangement 30 and a second pulley arrangement 31, the first pulley arrangement 30 being operationally positioned below the second pulley arrangement 31.

In the first configuration A the first pulley arrangement 30 and the second pulley arrangement 31 respectively comprise first pulleys 32 and second pulleys 33 that are free to rotate around the same rotation axis that are substantially parallel to the wrapping axis Z.

In use, a first pulley 32 and a second pulley 33 are rotatably associated with an end 34, for example, a cylindrical end, of the supporting element 11, this end 34 being positioned on a side opposite the corresponding fixing element 24.

In this way, in use, the first driving belt 28 and the second driving belt 29 each define a flexible ring.

Further, the first driving belt 28 is provided with a first, toothed, inner side 37, and with a first, smooth, outer side 39, whilst the second driving belt 29 is provided with a second, toothed, inner side 38, and with a second, smooth, outer side 40.

In an embodiment of the invention, the first inner side 37 and the second inner side 38 are smoothed.

The first inner side 38 and the second inner side 40 are arranged respectively for contacting the first pulleys 32 and the second pulleys 33 and for engaging a first sprocket 41 and a second sprocket 42 rotated respectively by the first motor 25 and by the second motor 26 and arranged for dragging through friction the first driving belt 38 and the second driving belt 39.

On the other hand, on the first, smooth, outer side 39 and on the second outer side 40 there are wound, at least partially, respectively a first driven belt 35 and a second driven belt 36.

The first driven belt 35, rotated by the first driving belt 28, is deviated by the first snub pulleys 43, positioned on the carriage 6, on a driving pulley 44 associated with the first roller 22, which rotates the latter at a rotation speed that is adjusted by the first motor 25.

The second driven belt 36, rotated by the second driving belt 29, is deviated by second snub pulleys 143, positioned on the carriage 6, on an idle pulley 45 supported by the first roller 22 and coaxial with the driving pulley 44.

The idle pulley 45 is arranged for rotating a first gear wheel 46 coaxial to it that is arranged for engaging a second gear wheel 47 associated with the second roller 23 that rotates the latter at a rotation speed adjusted by the second motor 26.

In this way, by suitably varying the rotation speeds of the motor 18, of the first motor 25 and of the second motor 26 it is possible to vary an unwinding speed of the film 3 in function of an angular position of the carriage 6 with respect to the product 8 and adjust a prestretching or elongating value of the film 3.

In an embodiment of the invention, which is not shown, the second driven belt 36 is deviated by further snub rollers associated with the carriage 6 directly on a further driving pulley associated with the second roller 23.

In still another embodiment of the invention, which is not shown, there is provided only the first motor 25 that rotates the first driving belt 28 that drags the first driven belt 35 through friction.

The second driven belt 35 is connected to, and rotates, the first roller 22, which, through fixed-ratio transmission, drives the second roller 23.

In FIG. 7 there is shown a second configuration B of the wrapping machine 1.

In the second configuration B further supporting elements 49 are fixed to the frame 4 that are adjacent to the supporting elements 11 and are positioned opposite the wheels 13.

Each further supporting element 49 supports a first wheel 50 and a second wheel 51 that are free to rotate around a substantially horizontal rotation axis, the first wheel 50 being operationally positioned below the second wheel 51.

In this way, the first wheels 50 and the second wheels 51 of each further supporting element 49 act as a support, respectively, for the first pulley arrangement 30 and the second pulley arrangement 31.

In the second configuration B, the first pulley arrangement 30 and the second pulley arrangement 31 comprise respectively a first ring 52 and a second ring 53, having substantially a C section and rotating around the wrapping axis Z with respect to the frame 4 as they are rotatably engaged and supported, respectively, by the first wheels 50 and the second wheels 51.

The first ring 52 and the second ring 53 are further kept in position by other vertical axis wheels that are not shown. On the first ring 52 there are respectively wound the first driving belt 28 and the first driven belt 35, the latter being, for example, positioned operationally above the first driving belt 28.

On the other hand, on the second ring 53 there are respectively wound the second driving belt 29 and the second driven belt 36, the latter being, for example, positioned operationally below the second driving belt 29.

The operation of the wrapping machine 1 in the second configuration B is disclosed below.

The motor 18, via the main driving belt 17 rotates the rotatable ring 10 on which the carriage 6 is fixed.

The first motor 25 rotates via the first driving belt 28 the first ring 52, which in turn rotates the first driven belt 35.

Figure 1:
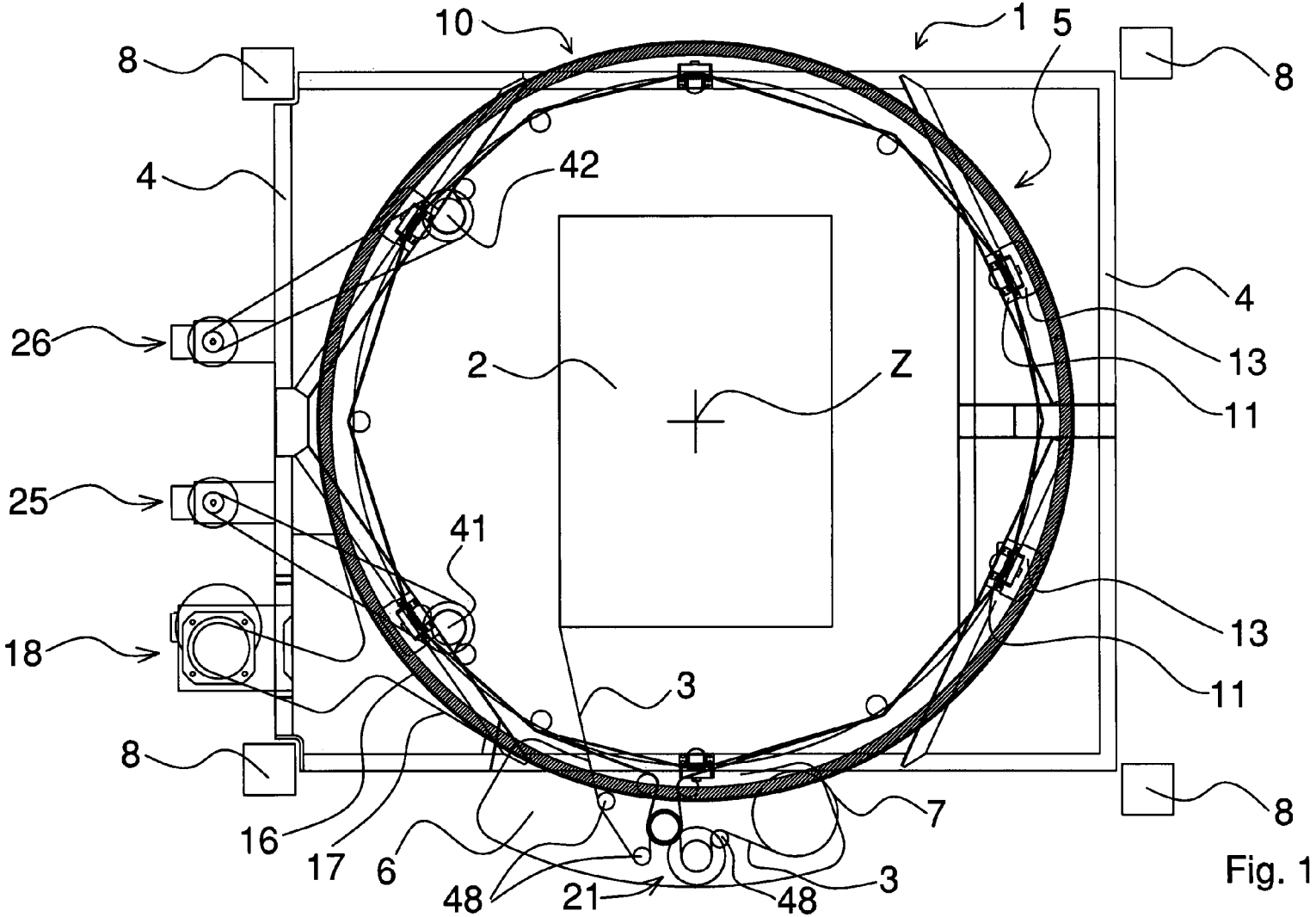
FIG. 1 is a schematic top view of the wrapping machine of the invention with some parts removed to better show others.
Figure 2:
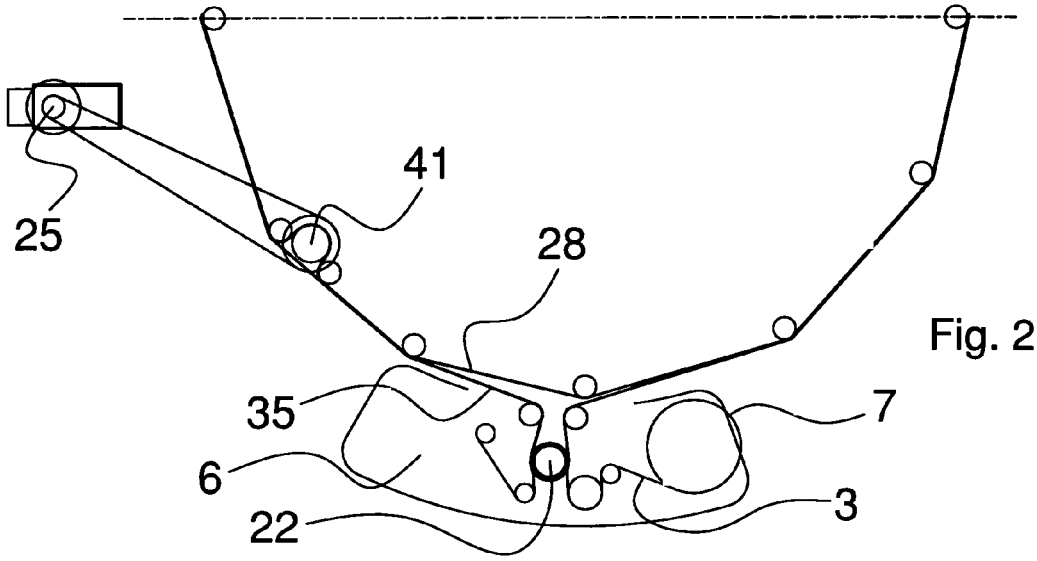
FIG. 2 is a fragmentary schematic view of FIG. 1 with some parts removed to better show others.

The first driven belt 35 is deviated from the first snub pulleys 43 to the driving pulley 44 that rotates the first roller 22 at a desired rotation speed (FIGS. 2 and 4).

The second motor 26 rotates via the second driving belt 29 the second ring 53, which in turn rotates the second driven belt 36.

Figure 3:
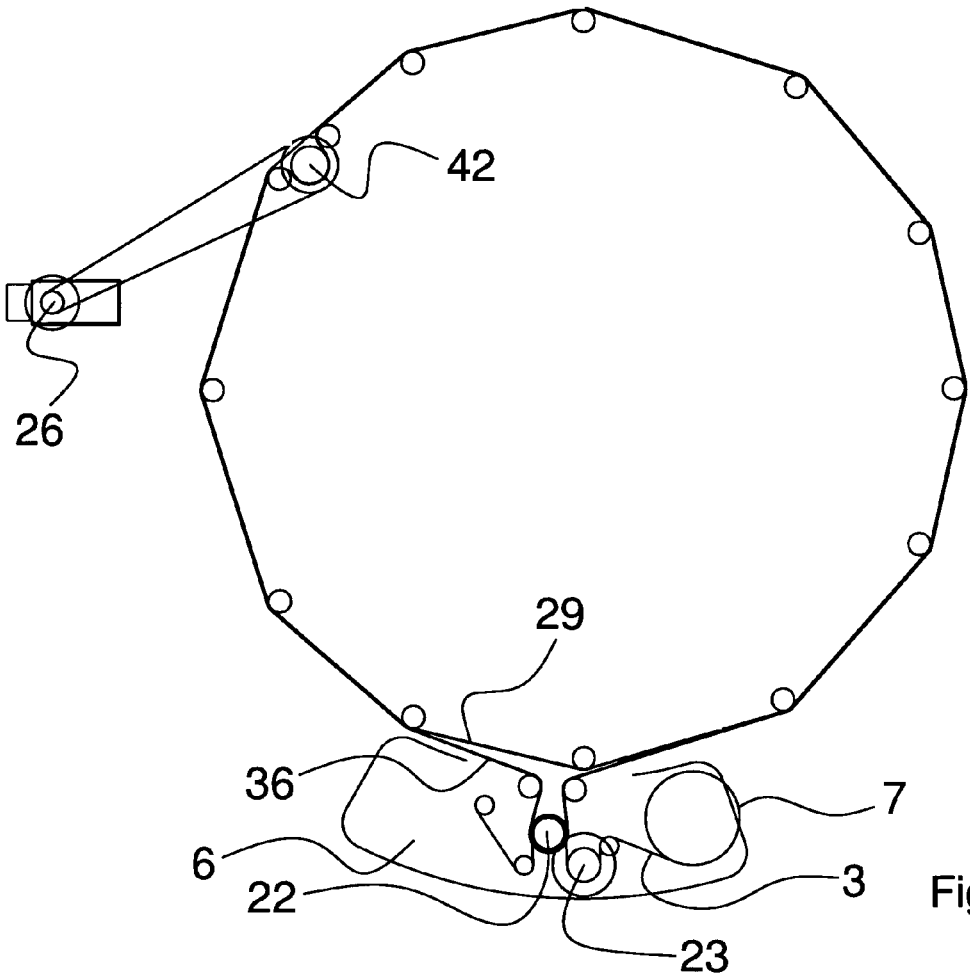
FIG. 3 is a schematic view from above of FIG. 1 with some parts removed to better show others.

The second driven belt 36 is deviated from the second snub pulleys 143 to the idle pulley 45 that rotates the first gear wheel 46 engaged on the second gear wheel 47 that rotates the second roller 23 at a desired rotation speed (FIGS. 3 and 5).

FIG. 8 shows a third configuration C of the wrapping machine 1.

In the third configuration C, with the frame 4 there are associated first supports 54 and second supports 55, which are substantially cylindrical and are operationally positioned outside the rotatable ring 10 with respect to the wrapping axis Z.

In particular, with the first supports 54 and the second supports 55 there are associated, angularly spaced apart from one another on an outer side 56 (FIG. 6) of the frame 4, the second supports 55 being positioned further outside the first supports 54 compared with the wrapping axis Z.

Each first support 54 and each second support 55 is arranged for supporting respectively the first pulley arrangement 30 and the second pulley arrangement 31.

In the third configuration C, the first pulley arrangement 30 and the second pulley arrangement 31 comprise, respectively, a further first pulley 57 and a further second pulley 58, that are free to rotate around respective rotation axes substantially parallel to the wrapping axis Z.

On the further first pulleys 57 and on the further second pulleys 58 a first transferring belt 59 and a second transferring belt 60 are respectively wound, the first transferring belt 59 being wider than the second transferring belt 60.

On an outer side of the first transferring belt 59 the first driving belt 28 and the first driven belt 35 are wound and dragged by friction, the latter being for example positioned operationally below and opposite the first driving belt 28.

On an outer side of the second transferring belt 60 the second driving belt 29 and the second driven belt 36 are wound and dragged by friction, the latter being, for example, positioned operationally below and on opposite sides of the second driving belt 29.

The operation of the wrapping machine 1 in the third configuration C is disclosed below.

The motor 18, via the main driving belt 17 drives the rotatable ring 10 on which the carriage 6 is fixed.

The first motor 25 rotates, via the first driving belt 28, the first transferring belt 59 which in turn rotates the first driven belt 35.

The first driven belt 35 is deviated from the first snub pulleys 43 to a further driving pulley 61 connected to the driving pulley 44 via a further belt 62 that rotates the first roller 22 at a desired rotation speed (FIG. 9).

The second motor 26 rotates, via the second driving belt 29, the second transferring belt 60 which in turn rotates the second driven belt 36.

The second driven belt 36 is deviated from a third snub pulley 163 to a first gear 64, supported by the carriage 6, that engages the second gear wheel 47 that rotates the second roller 23 at a desired rotation speed (FIG. 10).

In an embodiment of the invention that is not shown the first supports and the second supports are operationally positioned inside the rotatable ring with respect to the winding axis Z, the second supports being positioned further outside the first supports.

In this embodiment, the first motor rotates, via the first driving belt, the first transferring belt, which in turn rotates the first driven belt.

The first driven belt is deviated from the first snub pulleys to the driving pulley (FIG. 4) that rotates the first roller at a desired rotation speed.

The second motor rotates, via the second driving belt, the second transferring belt, which in turn rotates the second driven belt 36.

The second driven belt is deviated from the second snub pulleys (FIG. 5) onto the snub pulley that rotates the first gear wheel engaging the second gear wheel that rotates the second roller at a desired rotation speed.

FIG. 11 shows a fourth configuration D of the wrapping machine 1.

In the fourth configuration D supports 65 are fixed to the frame 4 that are angularly spaced apart from one another and are operationally positioned outside the rotatable ring 10 with respect to the wrapping axis Z.

In particular, the supports 65 are associated with the outer side 56 of the frame 4.

Each support 65 is arranged for respectively supporting the first pulley arrangement 30 and the second pulley arrangement 31.

In the fourth configuration D, the first pulley arrangement 30 and the second pulley arrangement 31 comprise respectively a main pulley 66 and a secondary pulley 67 coaxial with, and rotationally supported by, the main pulley 66, the secondary pulley 67 being received in an intermediate portion 68 of the main pulley 66.

In this way, the main pulley 66 is free to rotate around a rotation axis that is substantially parallel to the winding axis Z, whilst the secondary pulley 67 is free to rotate around the aforesaid rotation axis with respect to the main pulley 66.

The first driving belt 28 is wound at an end 69 of the main pulley 66 and the first driven belt 35 is wound around a second end 70 opposite the first end 69, between the first end 69 and the second end 70 there being interposed the intermediate portion 68.

Further, the first driven belt 35 is, for example, positioned operationally below the first driving belt 28.

Around the secondary pulleys 67 a third transferring belt 160 is wound that is arranged for supporting and dragging by friction the second driving belt 29 and the second driven belt 36, the latter being wound, at least partially, on the third transferring belt 160.

The operation of the wrapping machine 1 in the fourth configuration D is disclosed below.

The motor 18, via the main driving belt 17, rotates the rotatable ring 10 on which the carriage 6 is fixed.

The first motor 25 rotates by means of the first driving belt 28 the main pulley 66, which in turn rotates the first driven belt 35.

The first driven belt 35 is deviated from the first snub pulleys 43 onto the further driving pulley 61 that via the further belt 62 rotates the first roller 22 at a desired rotation speed (FIG. 9).

The second motor 26 rotates, via the second driving belt 29, the third transferring belt 160, which in turn rotates the second driven belt 36.

The second driven belt 36 is deviated from the third snub pulleys 163 onto the first gear 64, which engages the second gear wheel 47, which rotates the second roller 23 at a desired rotation speed (FIG. 10).

In an embodiment of the invention, which is not shown, the supports are operationally positioned inside the rotatable ring with respect to the wrapping axis Z.

In this embodiment, the first motor rotates, via the first driving belt, the main pulley, which in turn rotates the first driven belt.

The first driven belt is deviated from the first snub pulleys to the driving pulley (FIG. 4), which rotates the first roller at a desired rotation speed.

The second motor rotates, via the second driving belt, the second transferring belt, which in turn rotates the second driven belt.

The second driven belt is deviated from the second snub pulleys (FIG. 5) to the idle pulley that rotates the first gear wheel engaging the second gear wheel that rotates the second roller at a desired rotation speed.

It should be noted that the invention enables the productivity of the wrapping machines 1 to be increased.

In fact, as both the first motor 25 and the second motor 26 are positioned on the frame 4, it is possible to greatly lighten the weight of the ring arrangement. This, in addition to providing a simpler and less costly structure, enables the rotation speed of the ring arrangement to be increased considerably.

Further, it should be noted that it is possible to drive in an independent manner the first roller 22 and the second roller 23 respectively via the first motor 25 and the second motor 26. This enables a first rotation speed of the first roller 22 and a second rotation speed of the second roller 23 to be varied individually in a rapid and precise manner.

The difference between these two rotation speeds causes a corresponding value of the prestretching or elongating to which to subject the film 3 to be used.

Owing to the management and control unit that controls and adjusts the operation of the motors 25, 26 it is further possible to maintain this speed difference almost constant and therefore the corresponding prestretching force, also in the event of sudden variation of the first speed of the first roller 22 during wrapping of the film on the product.

Performing a calibrating phase of the prestretching force is further provided for each new reel of film of plastics to be used in the product unwinding process. This phases enables the optimal operating value of the prestretching force to be determined with precision to which the film 3 can be subjected, a value that further depends on the thickness and the type of material, on the physical and mechanical features thereof, such as the composition, the presence of impurities and/or dishomogeneity on the interior thereof.

The aforesaid phase performs a plurality of wrapping revolutions of the film 3 around a product 2, by acting on the rotation speed of one or both rollers 22, 23 in such a way as to increase progressively a speed difference between said speeds until the breakage of the film 3 is caused.

It is thus possible to set a speed operating difference for the prestretching rollers 22, 23 to be adopted. During operation of the machine 1, this operating difference being less than the speed difference that determines the breakage of the film.

The speed operating difference determines the optimum operating value of the prestretching force to be applied to the film 3.

It should be noted that the operating value of the prestretching force is independent of the shape and of the dimensions of the product or of the products to be wound.

The electronic management and control unit of the wrapping machine 1 further enables feedback control to regulate the operation of the main motor 18 and of the first motor 25 and second motor 26 in such a way as to keep almost constant a traction or tension force, the so-called "drag", to which to subject the film 3 during wrapping to obtain a package having desired features. This tension is part of the product 2 or of the products 2 to be wound and of the type of package to be obtained.

Very tight and stiff wrappings are required, for example to package and stabilise unstable products, or freer wrappings are required, for example, to protect single products that have already been packaged in the carton.

During the entire wrapping of the product the value of the tension of the film 3 has to be kept constant to optimize and control the consumption of the film. At the same unwinding speed a variation in tension determines greater or lesser consumption of film.

Tension tends to vary, as known, during the wrapping process. In fact, owing to the profile and/or dimensions of the product 2 to be wound, at each rotation, for each angular position of the carriage 6 around said product 2, the unwinding speed of the film 3, i.e. the quantity of film 3 to be dispensed, varies.

The management and control unit is able to measure the value of an operating parameter of the first motor 25 and/or of the second motor 26. This parameter is, for example, a resisting torque acting on the motor 25, 26, or a supply electric intensity current absorbed by the motor, or a frequency of said electric supply current.

The resisting torque on the motor 25, 26 is produced by the tension that the film 3 exerts on the prestretching rollers during wrapping on the product 2.

During operation of the wrapping machine 1, variations in the tension of the film 3 determine corresponding variations of the operating parameter—resisting torque—on the first motor 25 of the first roller 22, which variations are measured and sent to the management and control unit.

The latter intervenes on the first motor 25 in such a way as to increase or decrease the rotation speed of the first roller 22, i.e. the unwinding speed of the film 3, and to return the value of the resisting torque acting on the first motor 25 to the set value.

At the same time the management and control unit drives the second motor 26 to vary the speed of the second roller 23 in function of the new rotation speed of the first roller 22 in such a way as to maintain almost unaltered the speed difference between the rollers and thus the prestretching force applied to the film 3.

More precisely, the management and control unit compares instant by instant or at preset intervals of time, the operating parameter with a reference parameter stored therein and then intervenes on the first motor 25 in such a way as to diminish or at least eliminate a deviation detected between said operating parameter and said reference parameter.

The reference parameters are experimental values that correlate for example to tension of the film, rotation speed of the rotatable ring 10, rotation speed of the first roller 22, and resisting torque acting on the motors 25, 26.

It should be noted that the wrapping machine 1 and the control method disclosed above enable the tension of the film 3 to be controlled and maintained almost constant as it is wound around the product 2 even at high rotation speeds of the rotating ring 10 inasmuch as there is no requirement for a dandy roll, which is suitable for measuring the tension of the film, but is subject to delays and imprecisions in the transmission of the signal to the management and control unit.

On the other hand, the direct connection of the latter to the motors 25, 26 enables the speed of the prestretching rollers 22, 23 to be adjusted in an extremely precise and rapid manner in order to maintain substantially constant both the value of the tension of the film and the value of the prestretching force on the film, in any operating mode.

This enables the possibility of having undesired tension values to be reduced and even eliminated and therefore possible damage to the film 3 to be reduced and even eliminated during wrapping, and the quality of the wrapping compared with known machines to be consequently improved.

The aforesaid description, although with some different technical details, can also be extended to wrapping machines 1 in which the supporting structure 5 develops along a horizontal plane and the products 2 advance along a horizontal plane passing through the rotatable ring 10 to be wound by the film 3 in successive coils along a horizontal wrapping axis.

The invention claimed is:

1. A wrapping machine for wrapping a product with a plastic film comprising, a supporting frame with which a ring arrangement is associated that rotates around a wrapping axis of said film around said product and supports a carriage arranged for supporting a reel of said film and for supporting a first roller and a second roller cooperating for unwinding and stretching said film, a first motor fixed to said supporting frame and coupled with said first roller, a second motor fixed to said supporting frame and coupled with said second roller, a driving arrangement for coupling said first motor and said second motor with said first roller and with said second roller, respectively, said driving arrangement comprising a flexible driving arrangement, wherein said flexible driving arrangement comprises a first driving belt and a second driving belt rotated by said first motor and by said second motor, respectively, and acting on a first driven belt and on a second driven belt arranged for rotating said first roller and said second roller, respectively, said wrapping machine further comprising a motion transferring arrangement supporting and connecting said first driving belt and said first driven belt, and said second driving belt and said second driven belt, said motion transferring arrangement being arranged for transferring motion from said first driving belt to said first driven belt and from said second driving belt to said second driven belt, said motion transferring arrangement comprising a further ring arrangement that is rotatable around said wrapping axis.

2. A wrapping machine according to claim 1, wherein said further ring arrangement comprises a first ring and a second ring, said first ring being arranged for supporting said first driving belt and said first driven belt, said second ring being arranged for supporting said second driving belt and said second driven belt.

3. A wrapping machine according to claim 2, wherein said first ring and said second ring are rotatably supported by a second supporting arrangement associated with said supporting frame.

4. A wrapping machine according to claim 3, wherein said second supporting arrangement is connected with said supporting frame in an angularly spaced manner.

5. A wrapping machine according to claim 1, and further comprising a motion transmitting arrangement arranged for transmitting motion from said first driven belt to said first roller and from said second driven belt to said second roller.

6. A wrapping machine according to claim 5, wherein said motion transmitting arrangement is associated with said carriage.

7. A wrapping machine according to claim 5, wherein said motion transmitting arrangement comprises a first driving pulley associated with, and arranged for rotating, said first roller.

8. A wrapping machine according to claim 7, wherein said motion transmitting arrangement comprises a first snub pulley arranged for deviating said first driven belt onto said first driving pulley.

9. A wrapping machine according to claim 7, wherein said motion transmitting arrangement comprises a second driving pulley driven by said first driven belt and connected to said first driving pulley by a further belt arrangement.

10. A wrapping machine according to claim 5, wherein said motion transmitting arrangement comprises an idle pulley rotatably associated with said first roller.

11. A wrapping machine according to claim 10, wherein said motion transmitting arrangement comprises a second snub pulley for deviating said second driven belt onto said idle pulley.

12. A wrapping machine according to claim 10, wherein said motion transmitting arrangement comprises a first gear wheel associated with said idle pulley.

13. A wrapping machine according to claim 12, wherein said motion transmitting arrangement comprises a second gear wheel associated with said second roller and arranged for engaging said first gear wheel.

14. A wrapping machine according to claim 5, wherein said motion transmitting arrangement comprises a gear arranged for driving said second roller.

15. A wrapping machine according to claim 14, wherein said motion transmitting arrangement comprises a third snub pulley arranged for displacing said second driven belt onto said gear.

16. A wrapping machine according to claim 1, and further comprising an electronic control unit suitable for controlling at least a rotation speed of said first motor and of said second motor.

17. A wrapping machine according to claim 16, and further comprising a sensor device suitable for detecting at least an operating parameter of said first motor and of said second motor and sending a corresponding signal to said control unit.

18. A wrapping machine according to claim 17, wherein said operating parameter is chosen from a group comprising: rotation speed, resisting torque, current intensity, and current frequency.

19. A method for unwinding a plastic film initially wound on a reel by a first roller arranged further downstream and driven by a first motor, and by a second roller arranged further upstream, comprising the steps of stretching said film by rotating said first roller at a first speed that is greater than a second speed at which said second roller rotates, said stretching step including individually controlling said first motor and a second motor driving said second roller and a calibrating phase in which a difference between said first speed and said second speed is progressively increased until it causes said film to break and an operating difference is determined between said first speed and said second speed that is less than said difference, said operating difference being adopted during said stretching step at the end of said calibrating phase.

20. A method according to claim 19, and further comprising the step of wrapping a product with said film while maintaining a desired tension on said film.

21. A method according to claim 20, wherein said unwinding comprises rotating said first roller at said first speed such as to give said film said desired tension.

22. A method according to claim 21, and further comprising the steps of detecting an operating parameter of said first motor, comparing said operating parameter with a reference parameter, intervening on said motor arrangement in such a way as to decrease a deviation detected between said operating parameter and said reference parameter.

23. A method according to claim 22, wherein said reference parameter is chosen from a group comprising: rotation speed, resisting torque, current intensity, and current frequency.

24. A method according to claim 22, wherein said detecting step comprises detecting at any instant a respective value of said operating parameter.

25. A method according to claim 22, wherein said detecting step comprises detecting at preset intervals respective values of said operating parameter.

* * * * *